US007301322B2

(12) United States Patent
Choi

(10) Patent No.: US 7,301,322 B2
(45) Date of Patent: Nov. 27, 2007

(54) CMOS CONSTANT VOLTAGE GENERATOR

(75) Inventor: Myung Chan Choi, San Jose, CA (US)

(73) Assignee: ZMOS Technology, Inc., San Jose, CA (US)

( * ) Notice: Subject to any disclaimer, the term of this patent is extended or adjusted under 35 U.S.C. 154(b) by 139 days.

(21) Appl. No.: 11/033,454

(22) Filed: Jan. 10, 2005

(65) Prior Publication Data

US 2005/0184797 A1 Aug. 25, 2005

Related U.S. Application Data

(60) Provisional application No. 60/539,051, filed on Jan. 23, 2004.

(51) Int. Cl.
*G05F 3/26* (2006.01)
*G05F 3/16* (2006.01)

(52) U.S. Cl. ..... 323/315; 323/313

(58) Field of Classification Search ..... 327/537–543; 323/315

See application file for complete search history.

(56) References Cited

U.S. PATENT DOCUMENTS 5,198,701 A * 3/1993 Davies et al. ..... 327/513
6,927,622 B2 * 8/2005 Rashid et al. ..... 327/538
6,963,188 B2 * 11/2005 Wich ..... 323/268
7,098,720 B1 * 8/2006 Dow ..... 327/513

OTHER PUBLICATIONS

Phillip E. Allen et al. CMOS analog circuit design. 2d ed. New York: Oxford University Press, 2003, Chapter 4.

* cited by examiner

*Primary Examiner*—Gary L Laxton
(74) *Attorney, Agent, or Firm*—John P. O'Banion

(57) ABSTRACT

A CMOS constant voltage generator circuit having input and output stages and at least one compensation stage. Each stage can comprise a single transistor or more typically a transistor stack. Current mirroring is performed between the input stage and compensation stage, as well as preferably between the input stage and output stage. The compensation stage also provides additional biasing to a transistor in the output stage to increase voltage regulation. Optionally, degeneration resistors (passive or active) are coupled to the source side, drain side, or a combination of source and drain sides in the compensation and output stages. Optionally, additional diode-coupled transistors are incorporated in the transistor stack of the output stage. The circuit provides accurate voltage reference ($V_{ref}$) output with lowered sensitivity to temperature and supply voltage.

38 Claims, 4 Drawing Sheets

CMOS CONSTANT VOLTAGE GENERATOR

CROSS-REFERENCE TO RELATED APPLICATIONS

This application claims priority from U.S. provisional application Ser. No. 60/539,051 filed on Jan. 23, 2004, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to integrated circuits, and more particularly to constant voltage generators.

2. Description of Related Art

A constant voltage generator ($V_{ref}$ generator) is widely used within many Integrated Circuit (IC) designs, such as voltage references, input buffers, voltage regulator circuits, and similar applications. Typically the most crucial requirement for a $V_{ref}$ generator is that of providing a constant output voltage regardless of operating voltage, ambient temperatures, operating temperatures and manufacturing process variations. Various BandGap References (BGR) which rely on the use of diodes or bipolar transistors (P-N junction potential) have been utilized for this purpose. Recently, however, CMOS $V_{ref}$ generators have drawn increasing attention because of their simple design, low power consumption, and their ability to be readily incorporated on-chip within a wealth of CMOS circuit designs.

FIG. 1 depicts a conventional CMOS $V_{ref}$ generator having a single input and output stage. The $V_{ref}$ output is generated through PMOS device MP2 from drop R1 in combination with active resistor MP1 and R2 forming a voltage divider with active circuits MN1 and MN2. However, conventional CMOS $V_{ref}$ generators exhibit substantial operating voltage and temperature variations which makes them unsuitable for use in a number of important applications.

Accordingly, a need exists for a system and method of generating an accurate voltage reference from simple CMOS circuitry while overcoming the problems with process variations, supply voltage changes, and temperature drift. These needs and others are met within the present invention, which overcomes the deficiencies of previously developed voltage generator systems and methods.

BRIEF SUMMARY OF THE INVENTION

Voltage reference generators according to the present invention utilize current mirror drivers with at least one compensation stage between the input and output stages of the device. An input stage comprises an input device, or preferably a stack of devices comprising at least one active device and one passive or active resistor comprising a load. For example, the input stage may comprise a self-biased transistor in series with at least one load resistor or at least one transistor load or transistor logic, the combination being coupled between drain and source supply voltages. A portion of the input stage is configured in a current-mirror relationship with a compensation stage which provides biasing to an output device, or stack of devices. Embodiments of the invention preferably utilize source degeneration resistors (i.e. passive or active) on the source or drain sides of one or more of the transistors to normalize current flow through the transistors over a wider $V_{dd}$ range, and optionally to provide temperature compensation with a proper selection of device temperature coefficient. Stacked elements may be used within the stages to reduce the effective resistance values. In addition, diode-coupled transistors can be incorporated, such as preferably in the output stage, to increase temperature compensation.

An embodiment of the present invention describes a constant voltage generator circuit, comprising: (a) a voltage source (i.e. current-mirror driver) having an input stage, at least one compensation stage, and at least one output stage; (b) means for establishing a first current-mirror relationship between the input stage and both the compensation stage and the output stage; (c) means for establishing a second current-mirror relationship, or biasing relationship, between the compensation stage and the output stage; and (d) at least one active resistor device within the output stage whose resistance is modulated in response to receiving a biasing signal from the second current-mirror to compensate a constant reference voltage output from the output stage.

In this voltage reference device each stage preferably comprises at least one transistor device, or a stack of transistors, or a combination of transistors and either active or passive resistors. The voltage reference circuit may also incorporate one or more source degeneration resistors within the compensation stage, and/or output stage. In a preferred embodiment the source degeneration resistors are configured with a positive temperature coefficient to provide additional temperature compensation within the circuit.

The voltage reference circuit may also incorporate one or more diode-connected transistors (NMOS or PMOS) in the output stage to aid in temperature compensation of the output voltage. The diode-connected transistors are preferably configured with a negative temperature coefficient. The means for establishing the first current-mirror relationship within the circuit preferably comprises self-biasing a transistor within the input stage and coupling that self-biasing signal from the input stage to bias a transistor in each of the compensation stage and output stage.

The means for establishing a first current-mirror preferably comprises an interconnection between NMOS transistors within the input, compensation and output stages. The means for establishing the second current-mirror relationship comprises self-biasing a transistor within the compensation stage and coupling that self-biasing signal from the compensation stage to bias a transistor in the output stage. Furthermore, the means for establishing a second current-mirror comprises an interconnection between PMOS transistors within the compensation and output stages. It will be appreciated that additional compensation stages may be added which bias active devices in the output stage to further increase the accuracy of regulation.

Another embodiment of the invention describes a constant voltage generator circuit, comprising: (a) a voltage source having an input stage, at least one compensation stage, and at least one output stage; (b) at least one first active device within the input stage is configured for receiving a self-biasing signal; (c) at least one second active device within the compensation stage is configured for receiving the self-biasing signal of the first active device to establish a first level of current mirroring on the compensation stage; (d) at least one third active device within the output stage is configured for receiving the self-biasing signal of the first active device according to the first level of current mirroring; (e) at least one fourth active device within the compensation stage is configured for receiving a self-biasing signal; (f) at least one fifth active device within the output stage is configured for receiving the self-biasing signal from the fourth active device to establish a second level of current-mirroring; (g) a voltage generator output connection is coupled within the output stage between the third active device and the fifth active device; and (h) at least one sixth active device within the output stage is configured for receiving the self-biasing signal from the fourth active device and having a resistance that varies in response to the biasing input toward compensating the voltage output from the voltage generator output.

The first current-mirror in this circuit is preferably established on the source supply voltage side of the respective circuit stages, while the second current-mirror is established on the drain supply voltage side of the respective circuit stages. The circuit/device comprises PMOS and NMOS transistors fabricated according to a CMOS process technology. The resistive characteristics of the transistors in the input stage, compensation stage, and the output stage, are configured by controlling their size, geometry, or both. In one embodiment, the size of the transistors is changed by open-circuiting (i.e. blowing) of electrical fuses within the circuit to select transistor sizing, or selecting a size within one or more mask steps, or both.

Another embodiment of the invention describes a method of generating a constant reference voltage, comprising: (a) forming a first current mirror relationship between an input transistor stage and at least one subsequent transistor stage; (b) forming a second current mirror relationship between a compensation stage and an output stage; and (c) wherein the biasing of the second current mirror relationship drives at least one active device in the output stage to modulate reference voltage output. The method can further comprise stabilizing the voltage reference output by adding degeneration resistances (passive or active resistors) in transistor stages which are coupled to the input transistor stage, and/or the use of diode-coupled transistors in the output stage.

Embodiments of the present invention can provide a number of beneficial aspects which can be implemented either separately or in any desired combination without departing from the present teachings.

An aspect of the invention is to provide increased voltage regulator output accuracy.

Another aspect of the invention is to decrease output voltage fluctuations which arise in response to fabrication process variations, changes in temperature, changes in operating voltage, and combinations thereof.

Another aspect of the invention is the use of diode-coupled transistors, having negative temperature coefficients, within the transistor stacks to reduce effective resistance.

Another aspect of the invention is the use of degeneration resistors for improving voltage compensation within the voltage generator.

Another aspect of the invention is that source degeneration resistors can be passive or active resistors.

Another aspect of the invention is that the resistance values of transistors can be controlled by changing their sizes (width and/or length), such as through blowing electrical fuses and/or using mask steps.

Another aspect of the invention is that transistors can be stacked and yet have the same input toward reducing effective resistance values.

Another aspect of the invention is the ability to incorporate the voltage generator into separate circuit devices (i.e. voltage references, regulator, etc.) or integration within other circuit elements.

A still further aspect of the invention is that improved voltage reference characteristics can be provided by the present circuit which can be fabricated according to generally conventional CMOS fabrication techniques.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
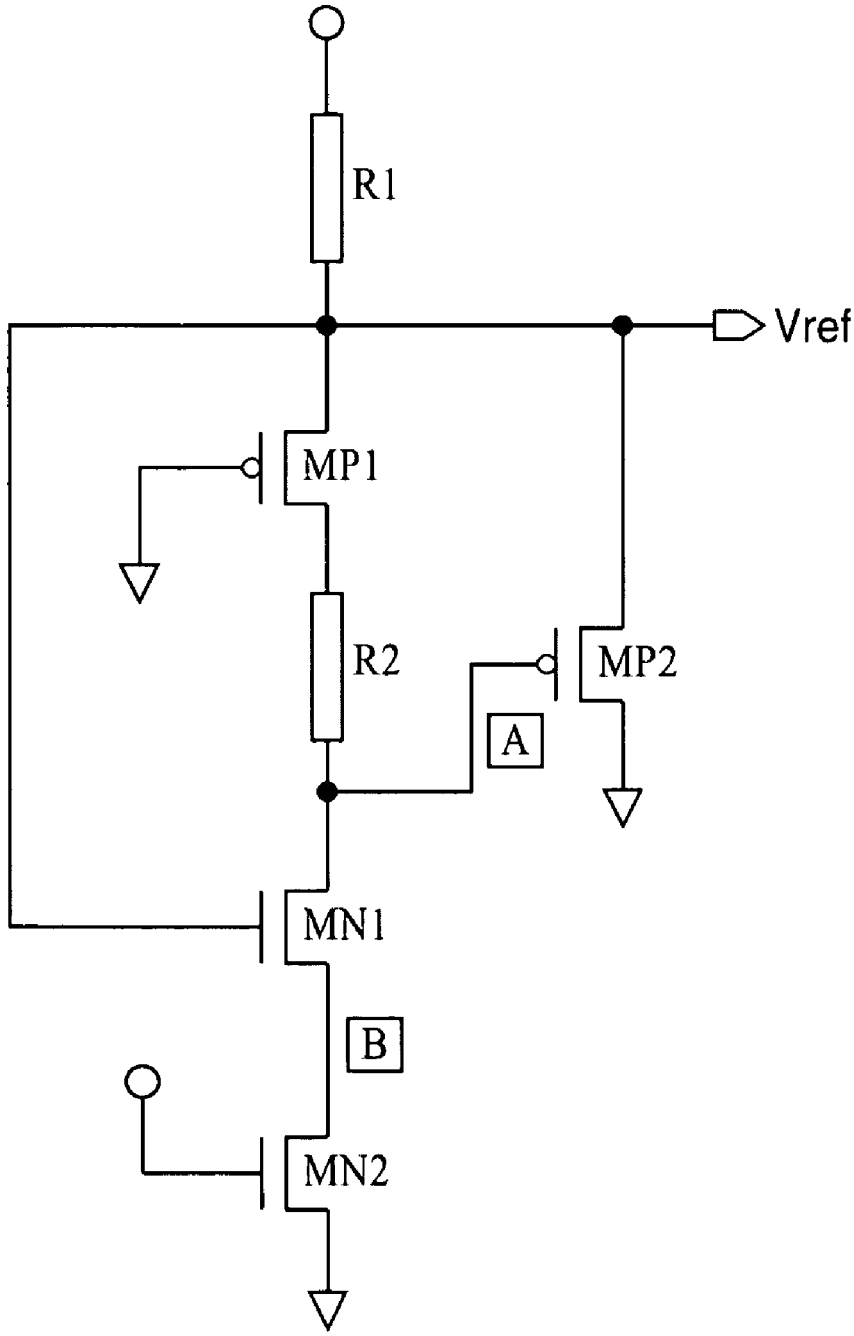
FIG. 1 (Prior Art)
FIG. 1 is a schematic of a conventional CMOS voltage reference generator, shown having an input and output stage.
Figure 2:
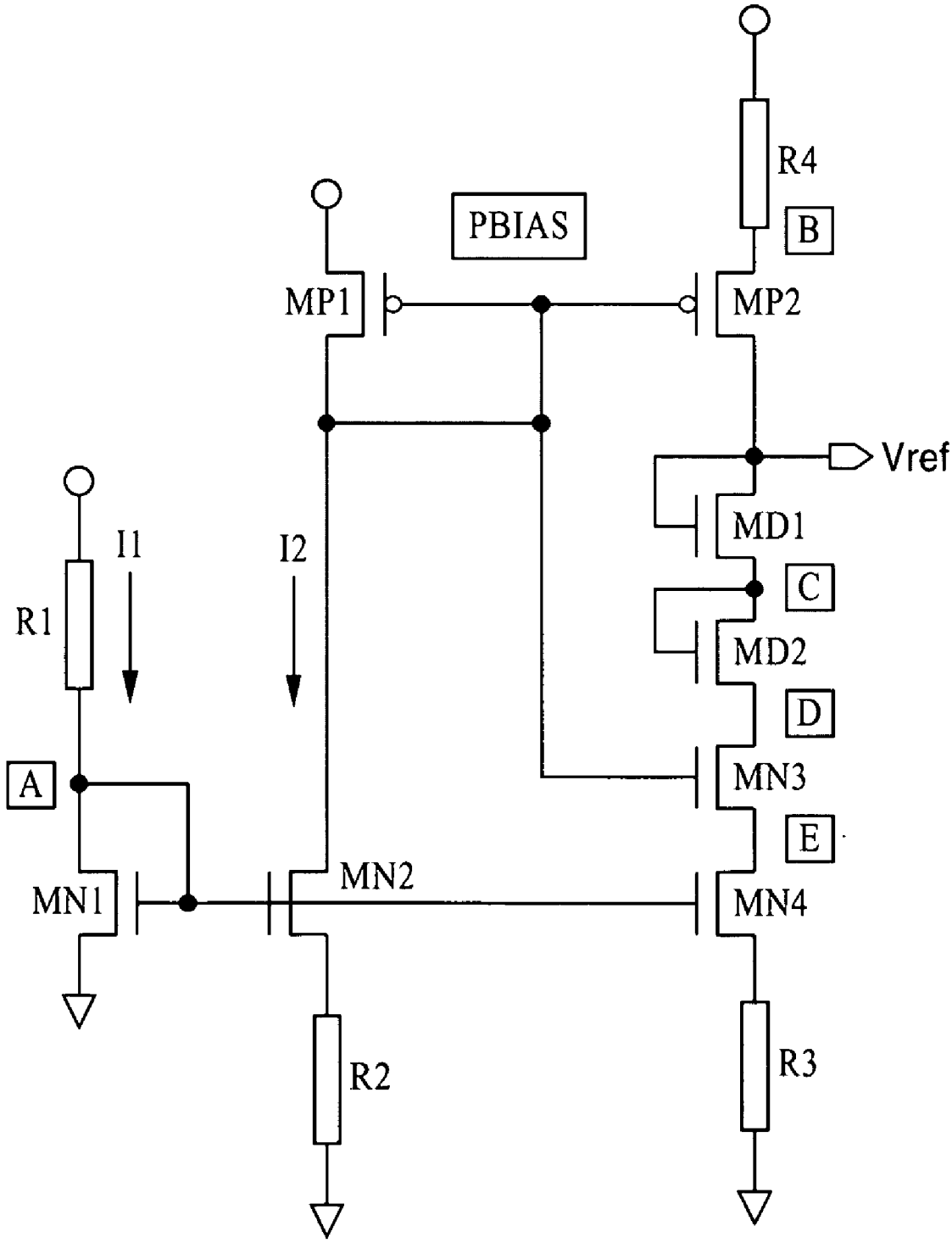
FIG. 2 is a schematic of a CMOS voltage reference generator according to an embodiment of the present invention, shown with one compensation stage and the use of source degeneration resistors.
Figure 3:
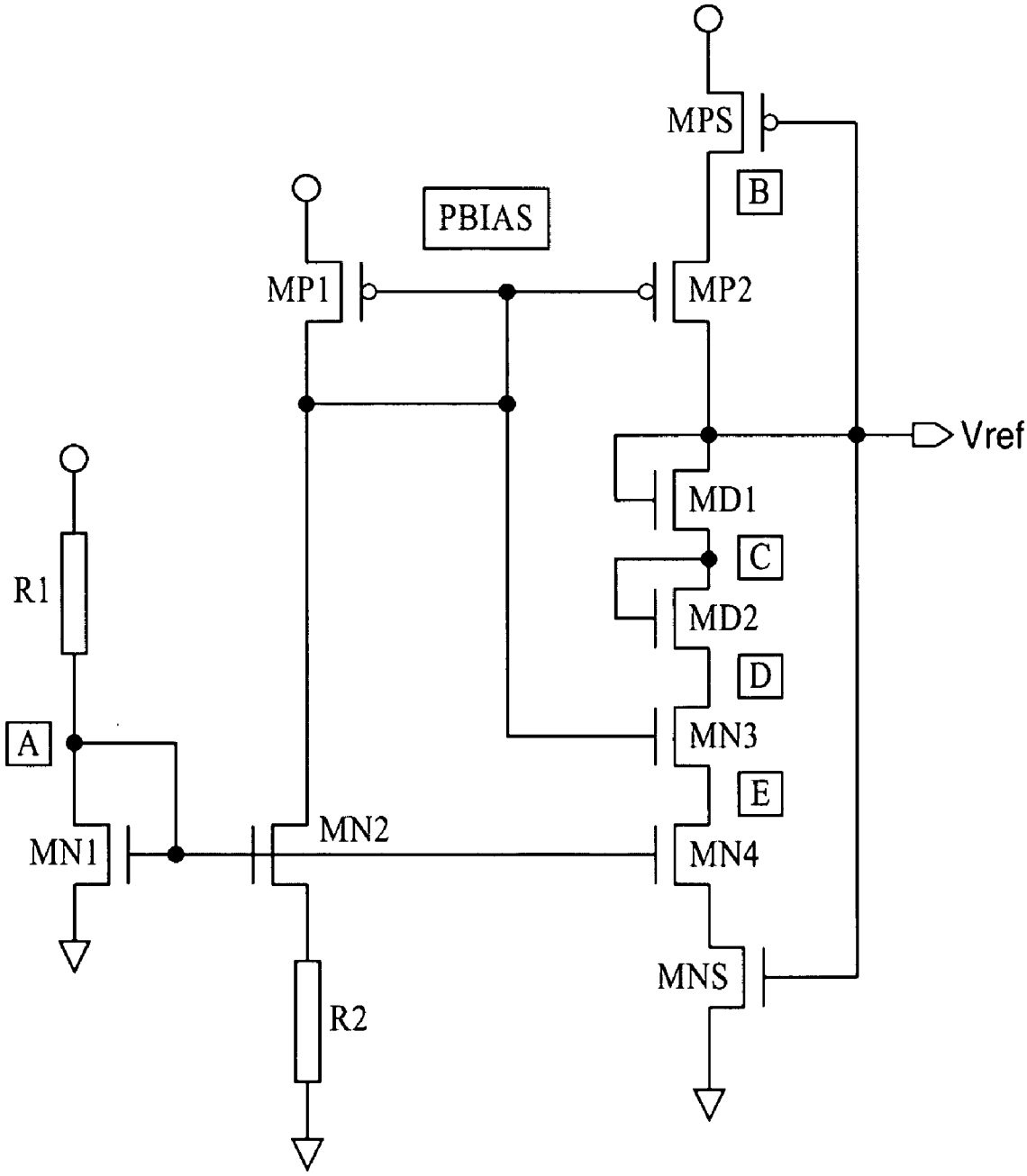
FIG. 3 is a schematic of a CMOS voltage reference generator according to an embodiment of the present invention, shown with one compensation stage and with active devices utilized as the degeneration resistors.
Figure 4:
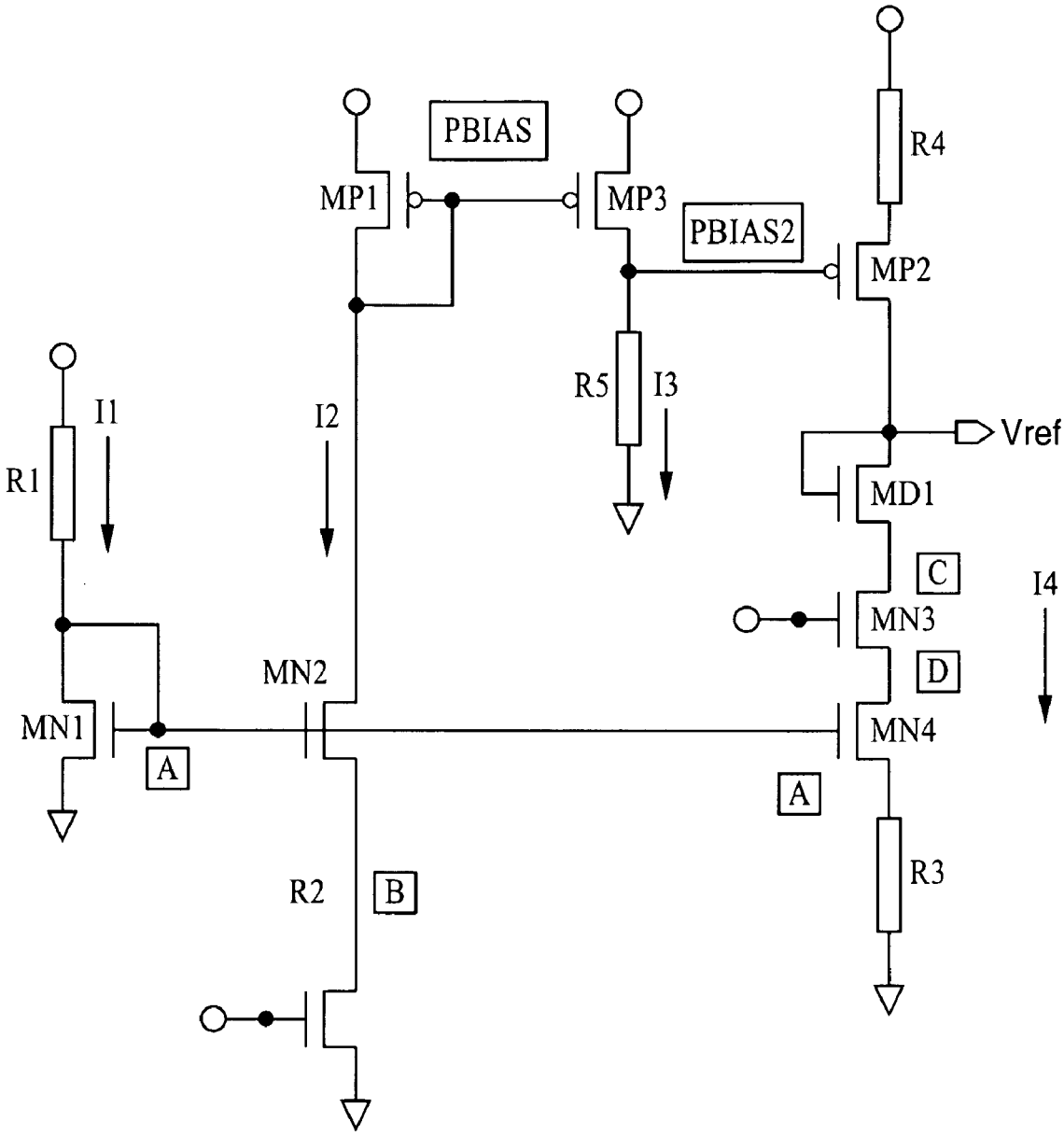
FIG. 4 is a schematic of a CMOS voltage reference generator according to an embodiment of the present invention, shown with two compensation stages.

Referring more specifically to the drawings for illustrative purposes, the present invention is embodied in the apparatus generally described in FIG. 2 through FIG. 4. It will be appreciated that the apparatus may be adapted for a variety of applications, without departing from the basic concepts disclosed herein. The present invention is a new type of CMOS voltage reference ($V_{ref}$) generator which is directed toward achieving superior compensation performance (i.e., reduced sensitivity to supply voltage ($V_{dd}$) and temperature variations) in relation with conventional CMOS $V_{ref}$ generators. The apparatus and methods of the present invention can be implemented within separate circuit elements (i.e.

voltage references, regulators, etc.) or integrated within other circuit elements, preferably those fabricated using CMOS processes (i.e. A/D converters, microcontrollers, comparator circuits and so forth).

FIG. 2 illustrates an example embodiment of a CMOS $V_{ref}$ generator according to the present invention which utilizes a voltage source configured with multiple current-mirror type drivers as a means of biasing the output stage. The input stage preferably comprises a simple bias circuit configured in a current mirror relationship with one or more other stages of the voltage generator. It should be appreciated that the input stage can be implemented as a simple combination of an active device with a passive or active transistor, although a more complex transistor stack or other topology may be utilized.

By way of example, the input stage comprises resistor R1 in combination with transistor MN1 and forms a bias circuit of a current mirror. Pairs of transistors are configured in a first current mirror relationship with MN1 including in this case MN2 and MN4. A second current mirror relationship is preferably established between MP1 and MP2 of the compensation and output stages, respectively. Optionally, source-degeneration resistors can be utilized, such as resistors R2, R3 and R4, to improve operating voltage ($V_{dd}$) compensation characteristics. Diode-coupled transistors, such as MD1 and MD2, in the output stage can comprise either NMOS or PMOS transistors. Transistor MN3 in the output stage is shown comprising an active resistor having a resistance value controlled by the bias voltage generated by the compensation stage.

During operation, in response to increasing operating voltage the voltage at node A reaches approximately $V_{m1}$, which is the threshold voltage of NMOS transistor MN1. Since transistors MN1 and MN2 form a current mirror, respective currents $I_1$ and $I_2$ are expected to be the same if the two transistors have the same size and structure. When the operating voltage goes up, the voltage at node A goes up since the voltage is divided by the resistance values of the two components R1 and MN1. In response to a node A voltage increase, MN2 is driven deeper into conduction and increased current flows through MN2. In addition, the drain voltage of MN2 is determined by the resistance ratio of MP1 and MN2. The two transistors MN1 and MN2 in this embodiment are configured with different characteristics.

To improve the operating voltage-dependent characteristics, a resistor is added at the source of MN2, called a source-degeneration resistor, which aids in maintaining a constant current flowing through transistor MN2 in response to changes in supply voltage levels $V_{dd}$. Since a voltage appears across R2, the gate-source voltage ($V_{GS}$) of MN2 is smaller than that of MN1. When $V_{dd}$ is increasing, since a certain voltage still appears across the resistor, if the resistor is large enough so that a large portion of voltage appears across the resistor R2 rather than MN2, the gate-source voltage ($V_{GS}$) and drain-source voltage ($V_{DS}$) of MN2 can be accurately maintained to stabilize circuit response characteristics. Another advantage of adding R2 is to maintain the node of PBIAS closer to a voltage less than $V_{dd}$ by a voltage amount $V_{tp}$ since the large voltage still appears across resistor R2. Source-degeneration resistor R4 provides similar compensation benefits as provided by degeneration resistor R2.

The voltage of node PBIAS is expected to be lower than $V_{dd}$ by an amount $V_{tp1}$, which is a threshold voltage of PMOS transistor MP1. Due to the voltage divided across transistors MP1, MN2 and resistor R2, the voltage of node PBIAS becomes slightly less than $V_{tp}$. It will be appreciated that resistor R2 helps node PBIAS maintain a closer voltage to $V_{dd}$-$V_{tp}$ than in the absence of resistor R2. By adding a source-degeneration resistor at the source of MP2, the current flowing through MP2 can be maintained more constantly over the operating voltage range. The use of a source degeneration resistor at the $V_{dd}$ side, especially at the source of the PMOS driver transistor in the current mirror structure, provides numerous benefits according to the present invention. The addition of source-degeneration resistor R3 provides similar benefits.

Diode-coupled transistors can be optionally incorporated within the transistor stacks to provide temperature compensation, such as utilizing negative temperature coefficient diode-coupled transistors on the source side to achieve a stable temperature compensated output voltage level of $V_{ref}$. It will be appreciated that the voltage drop across a given diode is reduced in response to temperature increases. Both NMOS and/or PMOS transistors can be utilized for creating the diode-coupled transistors within the stack.

Transistor MN3 in the output stack is preferably configured with a positive temperature coefficient. As $V_{dd}$ increases, the voltage of node PBIAS increases sufficiently to bias transistor MN3 into its linear region, wherein MN3 acts like a linear active resistor for maintaining $V_{ref}$ output and providing temperature compensation in response to the increasing resistance value of MN3 brought on by increasing temperature.

Transistor MN4 is coupled to the input stage current mirror in a similar manner as transistor MN2 within the compensation stage. Degeneration resistor R3 (active or passive) operates in a similar manner as resistor R2 to improve the current characteristics for $V_{dd}$ and reduce the operating current of the device.

FIG. 3 illustrates another embodiment of the invention in which the passive source degeneration resistors R3 and R4 of FIG. 2 have been replaced with active degeneration resistors MPS and MNS. These complementary active resistors are preferably biased, such as by the output reference voltage $V_{ref}$ to provide additional voltage and temperature compensation.

FIG. 4 illustrates another embodiment of the invention, in which an additional compensation stage is included. This example depicts the extra compensation stage as comprising a single transistor MP3 and an active or passive degeneration resistor R5. The additional compensation stage further increases voltage compensation of the circuit. It should be appreciated that any desired number of compensation stages can be utilized according to the teachings of the present invention.

A number of example voltage generator embodiments have been shown by way of schematic and described herein. It should be appreciated, however, that the present invention can also be considered a novel method of providing output voltage regulation within a voltage source. An input stage, at least one compensation stage, and an output stage are coupled together within a voltage source. Each stage comprises at least one active device, or a stack of active devices, or active devices in combination with passive or active resistors. A first current mirror relationship is established between an input transistor stage and at least one subsequent transistor stage. A second current mirror relationship, or biasing relationship, is established between a compensation stage and an output stage. According to this method the biasing of the second current mirror relationship drives at least one active device in the output stage to stabilize the reference voltage output.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A constant voltage generator circuit, comprising:

a voltage source;

said voltage source having an input stage, a compensation stage, and an output stage;

means for establishing a first current-mirror relationship between said input stage and both said compensation stage and said output stage;

means for establishing a second current-mirror relationship between said compensation stage and said output stage; and an active resistance device;

wherein said active resistance device has a resistance that varies in response to a bias signal from said means for establishing a second current-mirror relationship; and wherein modulation of said active resistance device stabilizes a constant reference voltage output from said output stage.

2. A constant voltage generator circuit as recited in claim 1, wherein each said stage comprises at least one transistor, or a stack of transistors, or a combination of at least one transistor and at least one active or passive resistor.

3. A constant voltage generator circuit as recited in claim 1, further comprising a source degeneration resistor in said compensation stage or said output stage or both said compensation stage and said output stage.

4. A constant voltage generator circuit as recited in claim 3, wherein said source degeneration resistor has a positive temperature coefficient.

5. A constant voltage generator circuit as recited in claim 1, further comprising:

a diode-connected transistor in the output stage;

said diode-connected transistor having a negative temperature coefficient to provide temperature compensation of output voltage.

6. A constant voltage generator circuit as recited in claim 1, wherein said constant voltage generator circuit comprises at least one PMOS or NMOS transistor or a combination of at least one PMOS and at least one NMOS transistor fabricated according to a CMOS process technology.

7. A constant voltage generator circuit as recited in claim 1, wherein said means for establishing said first current-mirror relationship comprises a self-biasing transistor in the input stage configured to bias a transistor in each of the compensation and output stages.

8. A constant voltage generator circuit as recited in claim 7, wherein said input stage comprises:

a self-biased transistor in series with a load resistor or a transistor load or transistor logic, coupled between drain and source supply voltages.

9. A constant voltage generator circuit as recited in claim 1, wherein said means for establishing a first current-mirror comprises an interconnection between at least one NMOS transistor in the input stage, at least one NMOS transistor in the compensation stage, and at least one NMOS transistor in the output stage.

10. A constant voltage generator circuit as recited in claim 1, wherein said means for establishing said second current-mirror relationship comprises a self-biasing transistor in the compensation stage configured to bias a transistor in the output stage.

11. A constant voltage generator circuit as recited in claim 1, wherein said means for establishing a second current-mirror comprises an interconnection between at least one PMOS transistor in the compensation stage and at least one PMOS transistor in the output stage.

12. A constant voltage generator circuit, comprising:

a voltage source;

said voltage source having an input stage, a compensation stage, and an output stage;

a first active device positioned in said input stage and configured for receiving a self-biasing signal;

a second active device positioned in said compensation stage and configured for receiving said self-biasing signal from said first active device to establish a first level of current mirroring of said compensation stage;

a third active device positioned in said output stage and configured for receiving said self-biasing signal from said first active device according to said first level of current mirroring;

a fourth active device positioned in said compensation stage and configured for receiving a self-biasing signal;

a fifth active device positioned in said output stage and configured for receiving said self-biasing signal from said fourth active device to establish a second level of current-mirroring;

a voltage generator output connection in said output stage and coupled between said third active device and said fifth active device; and a sixth active device positioned in said output stage and configured for receiving said self-biasing signal from said fourth active device, said sixth active device having a resistance that varies in response to the self-biasing signal to stabilize output voltage at said voltage generator output connection.

13. A constant voltage generator circuit as recited in claim 12:

wherein said input stage, a compensation stage, and an output stage have a source supply voltage side and a drain supply voltage side;

wherein said first level of current-mirroring is established on the source supply voltage side of said stages; and wherein the second level of current-mirroring is established on the drain supply voltage side of said stages;

wherein said constant voltage generator circuit comprises at least one PMOS and at least one NMOS transistors fabricated according to a CMOS process technology; and wherein said PMOS and NMOS transistors have resistive characteristics configured by controlling size or geometry, or both size and geometry of said transistors.

14. A constant voltage generator circuit as recited in claim 13, wherein the size of said transistors is changed by open-circuiting, blowing, of electrical fuses within the circuit to select transistor sizing, or selecting a size within one or more mask steps, or both.

15. A constant voltage generator circuit as recited in claim 12:

wherein said compensation stage and said output stage has a source and a drain; and further comprising an active or passive degeneration resistor in series with the source or drain, or both source and drain of the output stage and compensation stage.

16. A constant voltage generator circuit as recited in claim 12, further comprising:

a transistor stack in the output stage;

wherein said transistor stack further comprises at least one diode-coupled transistor which reduces effective resistance of transistors in the stack.

17. A method of generating a constant reference voltage in a circuit having a plurality of stages, comprising:

forming a first current mirror between an input stage and at least one subsequent stage;

said at least one subsequent stage including at least one compensation stage; and forming a second current mirror between at least one compensation stage and a first active device in an output stage;

wherein a biasing siginal applied to the gates of transistors within said second current mirror drives at least a second active device in the output stage to modulate reference voltage output.

18. A method as recited in claim 17, further comprising stabilizing the voltage reference output by adding degeneration resistance devices in stages which are coupled to the input stage.

19. A method as recited in claim 18, wherein said degeneration resistance devices comprise passive resistors, active resistors, or a combination of active and passive resistors.

20. A method as recited in claim 17, further comprising stabilizing the voltage reference output by configuring said output stage with one or more diode-coupled transistors.

21. A constant voltage generator circuit, comprising:

a voltage source having an input stage, a compensation stage, and an output stage;

a current-mirror between said input stage and said compensation stage;

a self-biasing circuit in said input stage configured to drive said first current-mirror whereby current is mirrored between said input stage and said compensation stage;

a drain side transistor in said output stage; and a source side transistor in said output stage;

wherein said compensation stage is coupled directly to the output stage, or indirectly through another active stage to the output stage, and configured for generating a bias voltage to said drain side transistor in response to current flow through said current-mirror; and wherein a constant current flowing through the combination of said drain side and source side transistors generates a constant reference voltage output.

22. A constant voltage generator circuit as recited in claim 21, wherein said constant voltage generator circuit comprises at least one PMOS transistor or at least one NMOS transistor or at least one PMOS transistor and at least one NMOS transistor fabricated according to a CMOS process technology.

23. A constant voltage generator circuit as recited in claim 22, wherein said current-mirroring of said compensation stage comprises source-side mirroring and drain-side mirroring with the output stage.

24. A constant voltage generator circuit as recited in claim 23:

wherein said drain-side mirroring is performed using gate-coupled PMOS transistors; and wherein said source-side mirroring is performed using gate-coupled NMOS transistors.

25. A constant voltage generator circuit as recited in claim 21:

wherein indirect coupling of said compensation stage to said output stage is provided by least one active device stage biased by said compensation stage and having active or passive degeneration resistors; and wherein at least one said active device stage is configured for generating a bias voltage.

26. A constant voltage generator circuit as recited in claim 21:

wherein said compensation and output stages have a source side and a drain side; and further comprising at least one active or passive degeneration resistor in series with the source side, or drain side, or both source and drain sides of the output stage and compensation stages.

27. A constant voltage generator circuit as recited in claim 26, wherein said source degeneration resistor is configured with a positive temperature coefficient.

28. A constant voltage generator circuit as recited in claim 26, wherein a drain-side degeneration resistor allows the drain-side transistor in the output stage to be biased by a node in the compensation stage to a voltage which exceeds the reference voltage output.

29. A constant voltage generator circuit as recited in claim 26, wherein said degeneration resistor comprises an active degeneration resistor biased by the reference voltage output to provide temperature compensation.

30. A constant voltage generator circuit as recited in claim 21, further comprising:

a transistor stack in the output stage;

wherein said transistor stack further comprises at least one diode-coupled transistor which reduces effective resistance of transistors in the stack.

31. A constant voltage generator circuit as recited in claim 21:

wherein said constant voltage generator circuit comprises at least one PMOS and at least one NMOS transistors fabricated according to a CMOS process technology; and wherein said PMOS and NMOS transistors have resistive characteristics configured by controlling size or geometry, or both size and geometry of said transistors.

32. A constant voltage generator circuit as recited in claim 31, wherein the size of said transistors is changed by open-circuiting, blowing, of electrical fuses within the circuit to select transistor sizing, or selecting a size within one or more mask steps, or both.

33. A constant voltage generator circuit, comprising:

an input stage comprising a first NMOS transistor, with a self-biasing gate connection, and a load resistor pulled up to a source power supply voltage;

at least one compensation stage comprising at least a second NMOS transistor having a gate coupled to the gate of said first NMOS transistor in said input stage, wherein a first current-mirror is established between said first and second NMOS transistor;

at least one output stage configured with at least a third NMOS transistor having a gate coupled to the self-biased first NMOS transistor of said input stage;

a second current-mirror established between a first PMOS transistor, which is self-biasing, in said compensation stage and a second PMOS transistor in said output stage;

at least a fourth NMOS transistor configured as an active resistor having a resistance which varies in response to the gate voltage applied between said first and second PMOS transistors in said second current-mirror; and an output connection in said output stage between said second PMOS transistor and said third NMOS transistor of said output stage.

34. In a constant voltage generator circuit having a self-biasing input within an input stage that biases an output stage generating a reference voltage output, the improvement comprising:

coupling a compensation stage in a first current-mirror relationship with the input stage;

establishing a second current-mirroring relationship between said compensation stage and said output stage; and coupling an output stage transistor to be driven by the gate bias from said first current mirror relationship with said input stage.

35. The improvement as recited in claim 34:

wherein said input, compensation and output stages have a source side and a drain side; and further comprising active or passive degeneration resistors coupled in series with the source side, drain side, or a combination of source and drain sides in the compensation and output stages.

36. The improvement as recited in claim 35, wherein said degeneration resistor comprises an active resistor in the output stage biased by the voltage reference output signal.

37. The improvement as recited in claim 34, further comprising at least one diode-connected transistor in the output stage having a negative temperature coefficient to temperature compensate the reference voltage output.

38. The improvement as recited in claim 34, wherein said first and second current-mirroring relationships are established toward opposing power supply voltage polarities.

* * * * *